US010780963B2

(12) United States Patent
Terlouw et al.

(10) Patent No.: US 10,780,963 B2
(45) Date of Patent: Sep. 22, 2020

(54) THRUSTER FOR PROPELLING A WATERCRAFT

(71) Applicant: VETH PROPULSION B.V., Papendrecht (NL)

(72) Inventors: Teunis Terlouw, Papendrecht (NL); Marco Gerritt Huisman, Papendrecht (NL); Hendrik Alexander Veth, Papendrecht (NL)

(73) Assignee: VETH PROPULSION B.V., Papendrecht (NL)

( * ) Notice: Subject to any disclaimer, the term of this patent is extended or adjusted under 35 U.S.C. 154(b) by 0 days.

(21) Appl. No.: 16/485,135

(22) PCT Filed: Feb. 16, 2018

(86) PCT No.: PCT/NL2018/050106

§ 371 (c)(1),
(2) Date: Aug. 9, 2019

(87) PCT Pub. No.: WO2018/151598

PCT Pub. Date: Aug. 23, 2018

(65) Prior Publication Data

US 2019/0382092 A1 Dec. 19, 2019

(30) Foreign Application Priority Data

Feb. 16, 2017 (NL) ..... 2018388

(51) Int. Cl.
*B63H 5/125* (2006.01)
*B63H 20/16* (2006.01)
(Continued)

(52) U.S. Cl.
CPC ..... *B63H 5/125* (2013.01); *B63H 20/16* (2013.01); *B63H 21/17* (2013.01); *B63H 23/04* (2013.01); *B63H 2005/1258* (2013.01)

(58) Field of Classification Search
CPC ..... B63H 5/125; B63H 20/16; B63H 21/17; B63H 23/04; B63H 2005/1258
See application file for complete search history.

(56) References Cited

U.S. PATENT DOCUMENTS 8,556,668 B2 * 10/2013 Kodera ..... B63H 21/21 440/3
9,796,462 B2 * 10/2017 Conesa Gracia ..... B63H 5/125

FOREIGN PATENT DOCUMENTS

EP 2 952 428 A1 12/2015
JP 2000-142576 A 5/2000
(Continued)

OTHER PUBLICATIONS

Doorduin, W., et al., "The use of electric motors for the propulsion of seagoing vessels.," pp. 23 (Oct. 28, 2013).

*Primary Examiner* — Stephen P Avila
(74) *Attorney, Agent, or Firm* — Maschoff Brennan

(57) ABSTRACT

A thruster for propelling a watercraft comprises at least one propeller on a rotatable propeller shaft and a motor for driving the propeller shaft through a drive arrangement, particularly a drive arrangement comprising a rotatable drive shaft and a coupling arrangement arranged between the drive shaft and an output shaft of the motor for coupling the drive shaft to the output shaft of the motor. The motor is a permanent magnet motor, the stator body of the motor being provided with a recess surrounding at least a part of the output shaft of the motor, and the coupling arrangement being at least partially located inside the recess so that a configuration having minimal constructional height is obtained.

16 Claims, 3 Drawing Sheets

Figure 1:
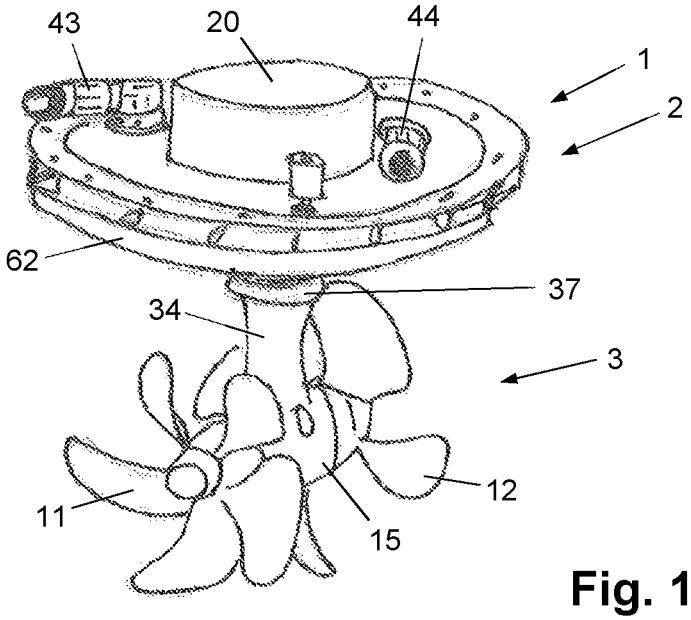

(51) Int. Cl.
*B63H 21/17* (2006.01)
*B63H 23/04* (2006.01)

(56) References Cited

FOREIGN PATENT DOCUMENTS

| | | | |
|---|---|---|---|
| NL | 1020217 | C1 | 3/1993 |
| WO | 2009/141254 | A2 | 11/2009 |

* cited by examiner

THRUSTER FOR PROPELLING A WATERCRAFT

The invention relates to a thruster for propelling a watercraft such as a ship, a boat, or a submarine. The invention furthermore relates to a watercraft comprising at least one thruster.

A thruster for propelling a watercraft is a well-known device. One watercraft may be equipped with more than one thruster. In general, a thruster comprises a wet portion and a dry portion, i.e. a portion that is intended to extend from a watercraft into the water under normal circumstances of the watercraft floating on/in water, and a portion that is intended to be accessible from the interior of the watercraft and not to be contacted by water. Typically, the wet portion comprises at least one propeller arranged on a propeller shaft to be rotated during operation of the thruster, and a housing arrangement comprising a gearbox portion for accommodating the propeller shaft and other components including gearing components, and a more or less elongated tube-shaped housing portion connecting to the gearbox portion at one side thereof, which serves for accommodating and surrounding a part of a drive shaft that is used for driving the propeller shaft. An end of the drive shaft extends into the gearbox portion, and the propeller shaft is coupled to the drive shaft through suitable gearing as present in the gearbox portion, extending perpendicular to the drive shaft and the output shaft of the motor. Optionally, the thruster is provided with a hollow cylindrical component that is designed to function as a nozzle, at a position for surrounding the at least one propeller. The dry portion comprises a motor for driving the propeller shaft through the drive shaft, the drive shaft being coupled to an output shaft of the motor through a coupling arrangement, and foundation components for supporting the motor and other components of the dry portion, and providing a basis from which components of the wet portion and components located at the interface of the dry portion and the wet portion are suspended. Furthermore, in order to prevent water from reaching the dry portion, the dry portion is closed at a side thereof facing the wet portion, by means of suitable sheeting, for example, and a watertight sealing arrangement is located at the interface of the dry portion and the wet portion.

In the following, for the sake of clarity, the direction in which the drive shaft and the output shaft of the motor normally extend will be referred to as vertical direction, and the direction in which the propeller shaft normally extends will be referred to as horizontal direction, which should not be understood such as to mean that the invention is limited to situations in which the respective shafts have an exact vertical and horizontal orientation. Furthermore, indications such as "lower" and "higher" or "upper" as used in this text are to be understood so as to refer to a normal, operational orientation of a thruster in which the gearbox portion and the at least one propeller are situated at the lowest level, and in which the motor and the foundation components are situated at the highest level, without limiting the invention to such orientation.

In a watercraft that is equipped with one or more thrusters, each thruster is fixedly attached to the watercraft at a suitable position on the watercraft's hull, and each thruster has a function in realizing movement of the watercraft. Operating a thruster involves having the motor of the thruster in an active state, as a result of which the output shaft of the motor, the drive shaft, and the propeller shaft and the propeller associated with the propeller shaft are rotated. Due to the interaction of the rotating propeller with the water surrounding it, a movement of the propeller in a direction in which the propeller shaft extends is realized, and as a result of the thruster being fixedly attached to the watercraft, the entire watercraft is moved. Normally, the thrusters are arranged on a longitudinal centre line of the watercraft and/or in pairs, at opposite sides of the longitudinal centre line, in a symmetrical fashion. Thrusters comprising a single propeller are known, but it is also a practical option for thrusters to comprise two propellers, particularly contra-rotating propellers, in which case the gearbox portion is designed to support two propellers and to accommodate two propeller shafts and suitable gearing for coupling each of the propeller shafts to the drive shaft.

It is to be noted that a thruster is an assembly of the components as mentioned in the foregoing, particularly a number of stationary components and a number of movable/rotatable components, and furthermore comprises additional components such as oil tubes or bearings of the drive shaft and the propeller shaft, which will not be further deliberated on here.

In the field of thrusters suitable for use with a watercraft, a type of thrusters known as azimuth thrusters is known. An azimuth thruster has a steering function besides a propelling function, so that in a watercraft that is equipped with one or more azimuth thrusters, a rudder can be omitted. Generally speaking, an azimuth thruster comprises an azimuth arrangement for setting an angular position of the propeller shaft with respect to stationary components of the thruster. It is known for the azimuth arrangement to comprise a slewing bearing including an outer ring that is coupled to the tube-shaped housing portion and the gearbox portion in such a way that the tube-shaped housing portion and the gearbox portion rotate along with the ring when the angular position of the ring is adjusted. For the purpose of rotating the outer ring of the slewing bearing to any desired angular position, the azimuth arrangement furthermore comprises at least one motor-driven pinion engaging with the ring. The azimuth arrangement comes with a system for processing steering input, i.e. input relating to a desired direction of movement of the watercraft, and controlling operation of the motor(s) for driving the at least one pinion so that an appropriate angular position of the outer ring of the slewing bearing is set at any time, and thereby an appropriate angular position of the tube-shaped housing portion, the gearbox portion and the propeller shaft accommodated by the gearbox portion.

In some types of watercraft, limited space is available. In view thereof, it is an object of the invention to provide a thruster of which the portion taking space inside the watercraft, i.e. the dry portion, is as low as possible.

According to the invention, a thruster for propelling a watercraft is provided, which comprises at least one propeller arranged on a propeller shaft to be rotated during operation of the thruster; a motor for driving the propeller shaft, comprising a rotatable output shaft; a drive arrangement coupling the propeller shaft to the output shaft of the motor, the drive arrangement comprising a rotatable drive shaft and a coupling arrangement arranged between the drive shaft and the output shaft of the motor for coupling the drive shaft to the output shaft of the motor, the drive shaft extending in substantially the same direction as the output shaft of the motor, and the propeller shaft being perpendicular to both the drive shaft and the output shaft of the motor; and a housing arrangement comprising a gearbox portion for accommodating the propeller shaft and other components including gearing components, an end of the drive shaft extending into the gearbox portion, and a tube-shaped housing portion accommodating and surrounding a part of the drive shaft, connecting to the gearbox portion at one side thereof; wherein the motor is a permanent magnet motor and comprises a stationary stator body and a rotatable rotor body, the output shaft of the motor extending from the rotor body; and wherein the stator body is provided with a recess at a side of the stator body where the drive arrangement is located, the recess surrounding at least a part of the output shaft of the motor, and the coupling arrangement being at least partially located inside the recess.

In the context of the invention, a specific type of motor is chosen, namely a permanent magnet motor. In comparison to the possible use of other types of motor, this allows for having a relative compact construction of the dry portion of the thruster, particularly for having a relatively low construction height. What's more, the invention is based on the surprising insight that the use of a permanent magnet motor allows for having an even further reduction of the construction height, namely by providing the stator body with a recess for receiving at least a part of the coupling arrangement. Hence, when the invention is applied, a reduction of the construction height of the portion of the thruster as present inside the watercraft is obtained, wherein this reduction has two aspects, namely the generally compact construction of the permanent magnet motor and an adaptation of the design of the stator body of the motor so as to allow for positioning the motor as far as possible down on the coupling arrangement. For the sake of completeness, in respect of the latter aspect, it is noted that in conventional situations, the motor is arranged at a higher level than the coupling arrangement, whereas according to the invention, a part of the motor and at least a part of the coupling arrangement overlap in the vertical direction.

It is possible for the thruster according to the invention to be an azimuth thruster. In that case, the thruster furthermore comprises an azimuth arrangement for setting an angular position of the propeller shaft with respect to stationary components of the thruster including the stator body of the motor, the azimuth arrangement comprising a slewing bearing including an outer ring supported on and fixedly connected to a steering flange, and at least one motor-driven pinion engaging with the ring for rotating the ring to an angular position as desired, wherein the tube-shaped housing portion, that is referred to as steering tube in the context of the azimuth thruster, is fixedly connected to the steering flange at the other side thereof. It follows from this definition that in this type of thruster according to the invention, the entirety of the steering tube and the gearbox portion extends downwardly from the steering flange. In this configuration, when the outer ring of the slewing bearing is rotated to an angular position as desired and the steering flange is automatically involved in that movement, it is achieved that a change of the angular position of the steering tube and the gearbox portion is obtained as well.

It is possible for the steering flange to be designed so as to be sufficiently strong for carrying the components of the thruster which are fixedly connected thereto, and also for absorbing forces and torques which occur as a result of a propelling movement during operation of the thruster for propelling a watercraft, so that there is no need for additional reinforcing and/or carrying/supporting components in the thruster, which contributes to an overall compact design of the thruster. In one advantageous practical embodiment, the steering flange has a central opening, the coupling arrangement being partially received in the steering flange at the position of the opening, and the drive shaft extending partially through the steering flange, wherein the steering flange comprises a sleeve-shaped portion besides a flange-shaped portion, the sleeve-shaped portion being centrally arranged in the steering flange and extending in the direction of the steering tube, the steering tube and the gearbox portion being suspended from the sleeve-shaped portion of the steering flange.

The configuration of the motor, the slewing bearing and the steering flange may be so that both the outer ring and an inner ring about which the outer ring is rotatable are arranged at a level for surrounding a part of the stator body of the motor, the flange-shaped portion of the steering flange being at a position for facing the motor at close range. Thus, if the thruster according to the invention is an azimuth thruster, compactness of design can still be optimal.

Advantageously, the flange-shaped portion of the steering flange is provided with a pattern of recesses and ribs at a surface thereof facing the motor. Manufacturing and handling of the steering flange are facilitated as a result thereof. The weight of the steering flange is within acceptable limits without compromising constructional strength. In view of the need for the steering flange to be sufficiently strong, it is furthermore advantageous for ribs extending in the same direction as the propeller shaft to be broader than the other ribs of the pattern, as those ribs are subjected to the highest load during operation of the thruster.

Figure 3:
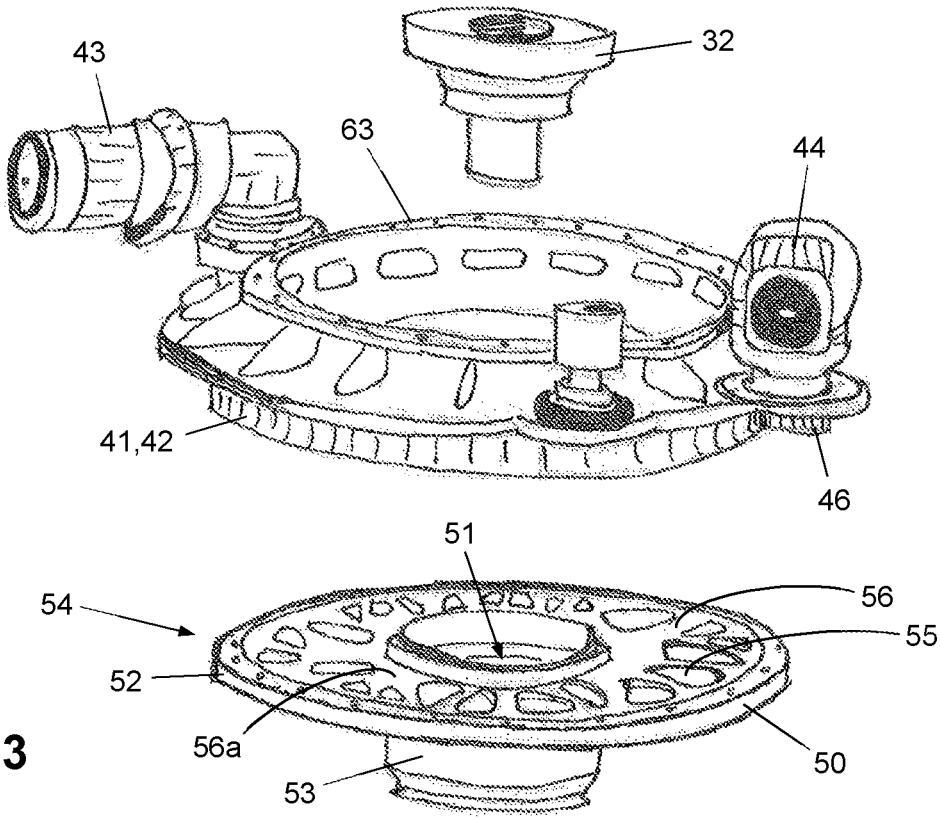
Figure 2:
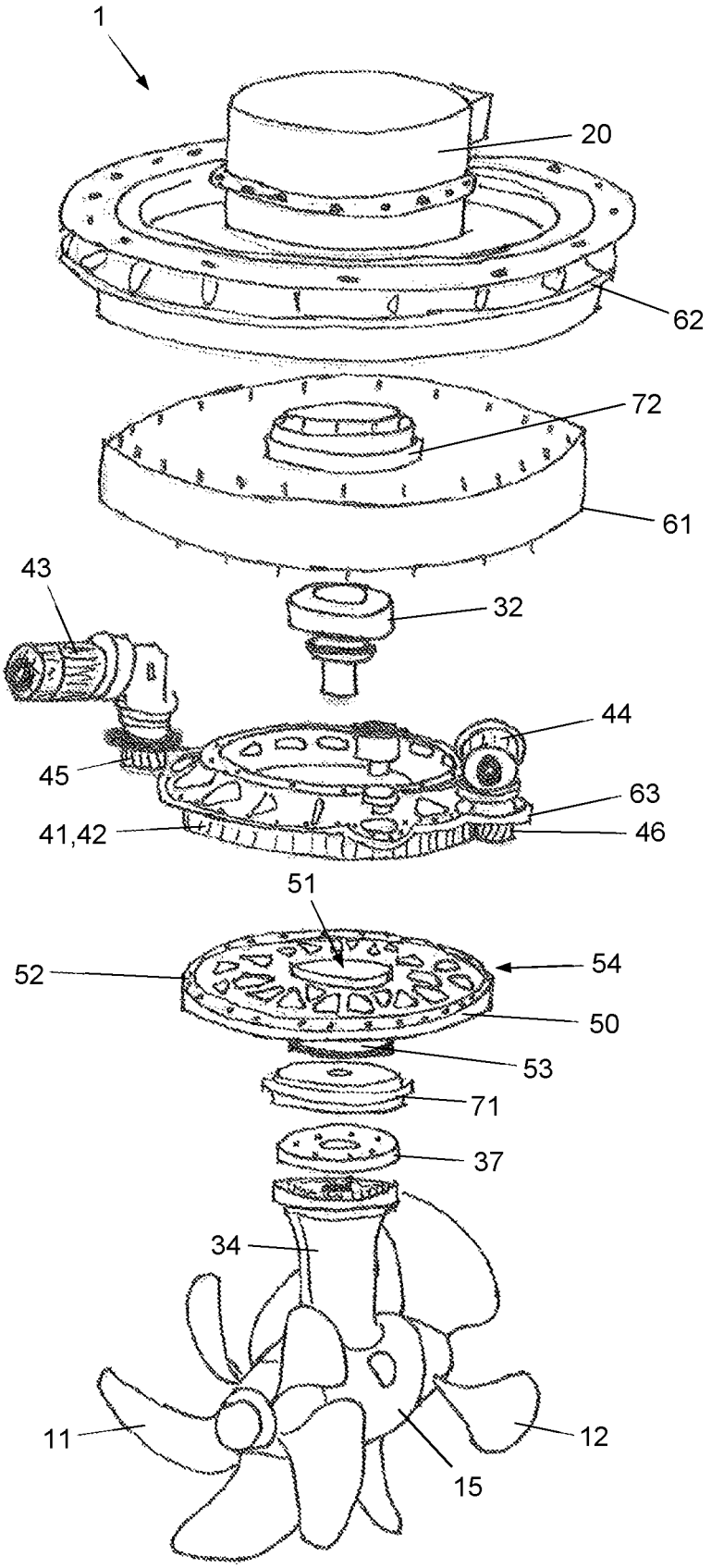

The invention will now be explained in greater detail with reference to the figures, in which equal or similar components are indicated by the same reference signs, and in which:

FIG. 1 diagrammatically shows a perspective view a thruster according to a preferred embodiment of the invention;

FIG. 2 diagrammatically shows an exploded view of the thruster shown in FIG. 1;

FIG. 3 diagrammatically shows a detail of FIG. 2; and

Figure 4:
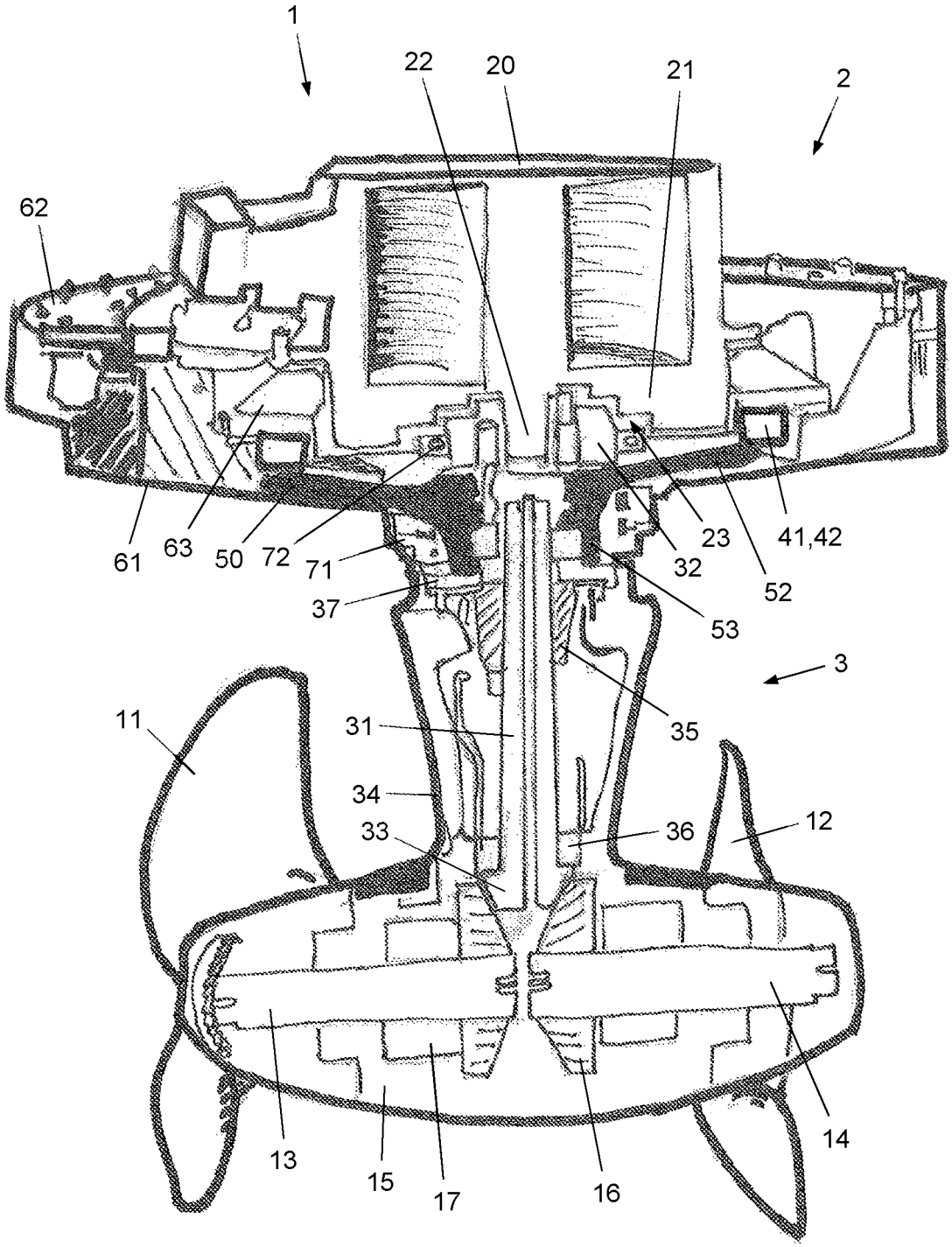

FIG. 4 diagrammatically shows a sectional view of the thruster shown in FIG. 1.

The orientation of the thruster and the various components thereof as shown in the figures is related to the normal, operational orientation of the thruster mentioned in the foregoing. It is emphasized once again that indications such as "vertical", "horizontal", "lower" and "higher" or "upper" as used in the present description with reference to the figures are to be understood in the context of that normal, operational orientation, and not such as to be limiting to the scope of the invention in any way.

FIGS. 1-4 relate to a thruster 1 according to a preferred embodiment of the invention. In conformity with the general description of a thruster as provided in the foregoing, it is noted that the thruster 1 is designed to be used for propelling a watercraft and to be fixedly attached to a watercraft at a suitable position on the watercraft's hull, with an upper, dry portion 2 positioned inside the watercraft's hull and a lower, wet portion 3 extending downwardly from the watercraft's hull.

At a lowest level, the thruster 1 comprises at least one rotatable propeller for realizing (part of) the propulsion that is needed for moving a watercraft. In the shown example, two contra-rotating propellers 11, 12 are used, which does not alter the fact that the invention is applicable to thrusters comprising only one propeller as well. As can be seen in FIG. 4, the propellers 11, 12 are arranged on respective propeller shafts 13, 14, at two sides of a gearbox portion 15 accommodating a number of components besides the propeller shafts 13, 14, such as gearing components 16 and bearings 17. The propeller shafts 13, 14 extend in substantially the same direction and at the same vertical level, one propeller shaft 13 extending from a central position inside the gearbox portion 15 to a first side of the gearbox portion 15, and the other propeller shaft 14 extending from the central position inside the gearbox portion 15 to a second, opposite side of the gearbox portion 15.

For the purpose of rotating the propeller shafts 13, 14 during operation, the thruster 1 is equipped with a motor 20. The motor 20 is a permanent magnet motor of which only the stator body 21 and the output shaft 22 are shown in FIG. 4. For the sake of clarity, other components which are known to be part of a permanent magnet motor, such as a rotor body and windings arranged thereon, are not shown. The thruster 1 furthermore comprises a drive arrangement coupling the propeller shafts 13, 14 to the output shaft 22 of the motor 20, the drive arrangement comprising a rotatable drive shaft 31 and a coupling arrangement 32 arranged between the drive shaft 31 and the output shaft 22 of the motor 20 for coupling the drive shaft 31 to the output shaft 22 of the motor 20 at a highest end thereof. The drive shaft 31 extends in substantially the same direction as the output shaft 22 of the motor 20, namely in a substantially vertical direction, whereas the respective propeller shafts 13, 14 are perpendicular to both the drive shaft 31 and the output shaft 22 of the motor 20, i.e. extend in a substantially horizontal direction.

As explained in the foregoing, the gearbox portion 15 serves for accommodating the propeller shafts 13, 14 and other components 16, 17. A lower end 33 of the drive shaft 31 extends into the gearbox portion 15, engaging with respective gears for imposing rotary movement on the respective propeller shafts 13, 14 during operation of the thruster 1. A major part of the drive shaft 31 is accommodated in and surrounded by a steering tube 34 that connects to the gearbox portion 15 at a lower side thereof, and that preferably constitutes one integral housing arrangement in combination with the gearbox portion 15. Suitable bearings 35, 36 are arranged between the interior surface of the steering tube 34 and the drive shaft 31.

Advantageously, in order for the thruster 1 to be useful for determining a direction of movement of a watercraft once installed on the watercraft, the thruster 1 is equipped with an azimuth arrangement. Within the framework of the invention, it is not essential that the thruster 1 has this added functionality of performing a steering action on a watercraft. When the thruster 1 comprises an azimuth arrangement, as is the case in the shown example, the azimuth arrangement is used for setting an angular position of the respective propeller shafts 13, 14 in the thruster 1, i.e. with respect to stationary components of the thruster 1. Thus, when an azimuth arrangement is present in the thruster 1, it is possible to vary the direction in which the propeller shafts 13, 14 extend in the horizontal plane with respect to the stationary components of the thruster 1 and consequently, when the thruster 1 is mounted on a watercraft, to the watercraft. In particular, the azimuth arrangement is configured and arranged to vary the horizontal angular position of the propeller shaft 13, 14 by varying the horizontal angular position of the assembly of the gearbox portion 15 and the steering tube 34. To this end, the azimuth arrangement comprises a slewing bearing including an outer ring 41 and an inner ring 42 about which the outer ring 41 is rotatable, and a steering flange 50, the outer ring 41 being supported on and fixedly connected to the steering flange 50, and the inner ring 42 being fixedly connected to a thruster foundation 61. FIG. 2 clearly illustrates the fact that in the shown example, the thruster foundation 61 is combined with another foundation component, namely a so-called bottom well 62 serving as a counter foundation component to which the thruster foundation 61 is fixedly connected.

The thruster 1 according to the shown embodiment comprises two electric motors 43, 44 for driving respective pinions 45, 46 that are in engagement with the outer ring 41 of the slewing bearing. The motors 43, 44 are supported on a carrier frame 63 that is fixedly connected to the combination of the thruster foundation 61 and the bottom well 62. By controlling the operation of the motors 43, 44 in a synchronized way, the angular position of the propeller shafts 13, 14 can be continuously varied as desired and dictated by manual or automatic steering input. For the sake of completeness, it is noted that the number of pinions 45, 46 and associated motors for controlling an angular position of the outer ring 41 of the slewing bearing is at least one, that the number may be two as illustrated, and that the number may also be more than two, whatever is appropriate in a particular case.

In the shown example, the steering flange 50 has a central opening 51 and comprises a flange-shaped portion 52 and a sleeve-shaped portion 53 extending downwardly with respect to the flange-shaped portion 52. At an upper side of the steering flange 50, the coupling arrangement 32 is partially received in the steering flange 50, whereas the sleeve-shaped portion 53 is at a position for surrounding a top end of the drive shaft 31. The assembly of the steering tube 34 and the gearbox portion 15 is fixedly connected to the sleeve-shaped portion 53 of the steering flange 50 through a coupling flange 37.

Various components of the thruster 1, such as the gearbox portion 15, the steering tube 34, the sleeve-shaped portion 53 of the steering flange 50 and the thruster foundation 61 have a function in covering rotating components and preventing water from reaching the components positioned inside. The thruster 1 is provided with two sealing arrangements 71, 72, one sealing arrangement 71 being arranged at the interface of the dry portion 2 and the wet portion 3 of the thruster 1, and the other sealing arrangement 72 being arranged between the steering flange 50 and the coupling arrangement 32.

The thruster 1 is operated by having the motor 20 in an active condition, i.e. a condition in which the output shaft 22 of the motor 20 rotates. The rotary movement of the output shaft 22 of the motor 20 is transmitted all the way down to the propeller shafts 13, 14 and the propellers 11, 12 through the coupling arrangement 32, the drive shaft 31 and the gears as present in the gearbox portion 15 and engaged by the lower end 33 of the drive shaft 31. Adjustments of the angular position of the propeller shafts 13, 14 as desired are obtained by rotating the pinions 45, 46 engaging the outer ring 41 of the slewing bearing, by means of the motors 43, 44 that are provided for that purpose. When the position of the ring 41 is adjusted over a certain angle, the position of the steering flange 50, the coupling flange 37, the steering tube 34 and the gearbox portion 15 including the propeller shafts 13, 14 is adjusted as well, in the same way.

A notable feature of the thruster 1 according to the invention resides in the fact that the thruster 1 has a compact design. Particularly, the height of the dry portion 2 of the thruster 1 is as low as possible, due to the fact that the motor 20 is a permanent magnet motor and that the design of the motor 20 is chosen so that the motor 20 can be arranged as low as possible on the underlying components of the thruster 1. The fact is that the stator body 21 of the motor 20 is provided with a recess 23 at a bottom side thereof. The shape of the recess 23 is adapted to the shape of the coupling arrangement 32, so that the coupling arrangement 32 can be partially located inside the recess 23. Furthermore, in this low position of the motor 20 with respect to the coupling arrangement 32, the flange-shaped portion 52 of the steering flange 50 extends right underneath the motor, and the slewing bearing including the outer ring 41 and the inner ring 42 about which the outer ring 41 is rotatable is located at a level for surrounding a part of the stator body 21 of the motor 20. With respect to a conventional design of a thruster, the motor 20, a top portion of the drive arrangement and components of the azimuth arrangement are positioned more closely together, without compromising the main functionalities of the thruster.

Within the framework of the invention, it is possible for the steering flange 50 to be a massive component, but it is preferred if the flange-shaped portion 52 of the steering flange 50 is provided with a pattern 54 of recesses 55 and ribs 56 at the upper surface thereof, i.e. the surface facing the motor 20, as is the case in the shown example, so that the steering flange 50 can have limited weight and still have sufficient constructional strength. In such a pattern 54, it is advantageous if ribs 56*a* extending in the same direction as the propeller shafts 13, 14 are broader than the other ribs 56 of the pattern 54, as is the case in the shown example.

It will be clear to a person skilled in the art that the scope of the invention is not limited to the examples discussed in the foregoing, but that several amendments and modifications thereof are possible without deviating from the scope of the invention as defined in the attached claims. While the invention has been illustrated and described in detail in the figures and the description, such illustration and description are to be considered illustrative or exemplary only, and not restrictive.

The various components of the thruster 1 according to the invention can be made of any suitable materials, including metal materials and plastic materials.

The compact design of the dry portion 2 of the thruster 1 according to the invention can be combined with any suitable design of the wet portion 3 of the thruster 1. For example, the wet portion 3 may have a larger length when compared to the dry portion 2 than illustrated in the figures, wherein it is possible that a generally cone-shaped arrangement known per se is applied, which may serve for providing bearing support to the slewing bearing in case the thruster 1 is an azimuth thruster.

The invention claimed is:

1. A thruster for propelling a watercraft, comprising:

at least one propeller arranged on a propeller shaft to be rotated during operation of the thruster;

a motor for driving the propeller shaft, comprising a rotatable output shaft;

a drive arrangement coupling the propeller shaft to the output shaft of the motor, the drive arrangement comprising a rotatable drive shaft and a coupling arrangement arranged between the drive shaft and the output shaft of the motor for coupling the drive shaft to the output shaft of the motor, the drive shaft extending in substantially the same direction as the output shaft of the motor, and the propeller shaft being perpendicular to both the drive shaft and the output shaft of the motor; and a housing arrangement comprising a gearbox portion for accommodating the propeller shaft and other components including gearing components, an end of the drive shaft extending into the gearbox portion, and a tube-shaped housing portion accommodating and surrounding a part of the drive shaft, connecting to the gearbox portion at one side thereof;

wherein the motor is a permanent magnet motor and comprises a stationary stator body and a rotatable rotor body, the output shaft of the motor extending from the rotor body; and wherein the stator body is provided with a recess at a side of the stator body where the drive arrangement is located, the recess surrounding at least a part of the output shaft of the motor, and the coupling arrangement being at least partially located inside the recess.

2. A thruster according to claim 1, further comprising an azimuth arrangement for setting an angular position of the propeller shaft with respect to stationary components of the thruster including the stator body of the motor, the azimuth arrangement comprising a slewing bearing including an outer ring supported on and fixedly connected to a steering flange, and at least one motor-driven pinion engaging with the ring for rotating the ring to an angular position as desired, wherein the tube-shaped housing portion is fixedly connected to the steering flange at the other side thereof.

3. A thruster according to claim 2, wherein:

the steering flange has a central opening, the coupling arrangement being partially received in the steering flange at the position of the opening, and the drive shaft extending partially through the steering flange, and the steering flange comprises a sleeve-shaped portion besides a flange-shaped portion, the sleeve-shaped portion being centrally arranged in the steering flange and extending in the direction of the tube-shaped housing portion, the tube-shaped housing portion and the gearbox portion being suspended from the sleeve-shaped portion of the steering flange.

4. A thruster according to claim 3, wherein the outer ring of the slewing bearing and an inner ring of the slewing bearing about which the outer ring is rotatable are arranged at a level for surrounding a part of the stator body of the motor, the flange-shaped portion of the steering flange being at a position for facing the motor at close range.

5. A thruster according to claim 3, wherein the flange-shaped portion of the steering flange is provided with a pattern of recesses and ribs at a surface thereof facing the motor.

6. A thruster according to claim 5, wherein ribs extending in the same direction as the propeller shaft are broader than the other ribs of the pattern.

7. A watercraft, comprising at least one thruster according to claim 1.

8. A thruster according to claim 4, wherein the flange-shaped portion of the steering flange is provided with a pattern of recesses and ribs at a surface thereof facing the motor.

9. A thruster according to claim 8, wherein ribs extending in the same direction as the propeller shaft are broader than the other ribs of the pattern.

10. A watercraft, comprising at least one thruster according to claim 2.

11. A watercraft, comprising at least one thruster according to claim 3.

12. A watercraft, comprising at least one thruster according to claim 4.

13. A watercraft, comprising at least one thruster according to claim 5.

14. A watercraft, comprising at least one thruster according to claim 6.

15. A watercraft, comprising at least one thruster according to claim 8.

16. A watercraft, comprising at least one thruster according to claim 9.

* * * * *